US010072622B2

(12) United States Patent
Yamada

(10) Patent No.: US 10,072,622 B2
(45) Date of Patent: Sep. 11, 2018

(54) CONTROLLER FOR INTERNAL COMBUSTION ENGINE AND CONTROL METHOD THEREFOR

(71) Applicant: Toyota Jidosha Kabushiki Kaisha, Toyota-shi, Aichi-ken (JP)

(72) Inventor: Kazuhiro Yamada, Okazaki (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 99 days.

(21) Appl. No.: 15/137,421

(22) Filed: Apr. 25, 2016

(65) Prior Publication Data

US 2016/0319784 A1 Nov. 3, 2016

(30) Foreign Application Priority Data

Apr. 28, 2015 (JP) ..... 2015-091519

(51) Int. Cl.

| | |
|---|---|
| ***F02M 37/20*** | (2006.01) |
| ***F02D 41/30*** | (2006.01) |
| ***F02M 37/10*** | (2006.01) |
| *F02D 41/38* | (2006.01) |

(52) U.S. Cl.

CPC ..... *F02M 37/20* (2013.01); *F02D 41/3082* (2013.01); *F02D 41/3094* (2013.01); *F02D 41/3854* (2013.01); *F02M 37/10* (2013.01); *F02D 41/3836* (2013.01); *F02D 2200/0602* (2013.01); *F02D 2200/0606* (2013.01); *F02D 2250/02* (2013.01); *F02D 2250/31* (2013.01)

(58) Field of Classification Search

CPC ..... F02D 2200/06; F02D 2200/0602; F02D 41/3082; F02D 41/3094; F02D 41/3836; F02D 41/3845; F02D 41/3854; F02D 41/3863; F02D 2250/02; F02D 2250/31

See application file for complete search history.

(56) References Cited

U.S. PATENT DOCUMENTS

| | | | | |
|---|---|---|---|---|
| 6,708,671 | B1 | 3/2004 | Joos et al. | |
| 7,007,662 | B2 * | 3/2006 | Sakai | F02D 41/3094 123/299 |
| 7,263,973 | B2 * | 9/2007 | Akita | F02D 41/3094 123/299 |
| 8,776,764 | B2 * | 7/2014 | Basmaji | F02D 19/0605 123/27 GE |

(Continued)

FOREIGN PATENT DOCUMENTS

| | | |
|---|---|---|
| JP | 2003-513193 A | 4/2003 |
| JP | 2005-098145 A | 4/2005 |

(Continued)

*Primary Examiner* — Sizo Vilakazi
*Assistant Examiner* — Kevin R Steckbauer
(74) *Attorney, Agent, or Firm* — Dinsmore & Shohl LLP

(57) ABSTRACT

When a state where a lowered amount of a detection value of high-pressure side fuel pressure with respect to target fuel pressure is at least equal to a specified lowering determination value at least continues for a specified lowering determination time, a pump high-temperature determination is set "ON". In the case where the pump high-temperature determination is set "ON", boost control for increasing pressure of fuel that is supplied from a feed pump to a high-pressure pump (a set value of feed pressure) from a low-pressure set value to a high-pressure set value is executed.

10 Claims, 4 Drawing Sheets

(56) References Cited

U.S. PATENT DOCUMENTS

| | | | | |
|---|---|---|---|---|
| 8,820,299 | B2 * | 9/2014 | Kojima | F02M 63/0245 123/198 D |
| 9,291,117 | B2 * | 3/2016 | Lee | F02D 41/221 |
| 9,599,060 | B2 * | 3/2017 | Sanborn | F02M 59/20 |
| 9,617,960 | B2 * | 4/2017 | Saito | F02D 41/3854 |
| 2005/0061298 | A1 | 3/2005 | Sakumoto et al. | |
| 2005/0193982 | A1 * | 9/2005 | Sakai | F02D 41/3094 123/431 |
| 2012/0167859 | A1 * | 7/2012 | Basmaji | F02D 19/0605 123/456 |
| 2013/0247874 | A1 * | 9/2013 | Saito | F02D 41/3854 123/446 |
| 2014/0053812 | A1 * | 2/2014 | Kojima | F02M 63/0245 123/457 |
| 2014/0165970 | A1 * | 6/2014 | Lee | F02D 41/221 123/495 |
| 2014/0251280 | A1 * | 9/2014 | Ikoma | F02D 41/042 123/478 |
| 2015/0144108 | A1 * | 5/2015 | Kim | F02M 69/54 123/460 |
| 2015/0252764 | A1 * | 9/2015 | Cho | F02M 59/20 123/496 |
| 2016/0090933 | A1 * | 3/2016 | Tsutsuji | G01L 27/007 73/1.57 |
| 2017/0022926 | A1 * | 1/2017 | Sanborn | F02D 41/3845 |
| 2017/0022927 | A1 * | 1/2017 | Sanborn | F02M 59/20 |

FOREIGN PATENT DOCUMENTS

| | | | |
|---|---|---|---|
| JP | 2006-329151 | A | 12/2006 |
| JP | 2009-185662 | A | 8/2009 |
| JP | 2012-122403 | A | 6/2012 |
| JP | 2013-113145 | A | 6/2013 |

* cited by examiner

CONTROLLER FOR INTERNAL COMBUSTION ENGINE AND CONTROL METHOD THEREFOR

CROSS-REFERENCE TO RELATED APPLICATIONS

The present disclosure claims priority to Japanese Patent Application No. 2015-091519 filed on Apr. 28, 2015, which is incorporated herein by reference in its entirety including the specification, drawings and abstract.

BACKGROUND

1. Technical Field

The present disclosure relates to a controller for an internal combustion engine and a control method therefor.

2. Description of Related Art

It has been known, for a purpose of injection into cylinders, that high-pressure fuel is supplied to an internal combustion engine of an in-cylinder injection type. The internal combustion engine of this type includes: a high-pressure pump that pressurizes fuel drawn from a fuel tank by a feed pump; and a high-pressure fuel pipe that stores the pressurized fuel. In this internal combustion engine of the in-cylinder injection type, the fuel is supplied from the high-pressure fuel pipe to a high-pressure fuel injection valve for in-cylinder injection.

When a fuel temperature in the high-pressure pump is raised to the boiling point of the fuel or higher, the fuel in the pump may be vaporized. Once the fuel in the pump is vaporized, the high-pressure pump is brought into a so-called vapor lock state. The vapor lock state refers to a state where, even when a pressurizing operation of the high-pressure pump is performed, vapor inside the high-pressure pump is merely compressed, and pressure is not applied to the liquid fuel. In Published Japanese Translation of PCT application No. 2003-513193 (JP 2003-513193 A), a controller for an internal combustion engine that prevents vapor lock is disclosed. The controller for the internal combustion engine in JP 2003-513193 A increases pressure of fuel that is supplied from feed pump to high-pressure pump when the fuel temperature in the high-pressure pump becomes at least equal to a threshold.

SUMMARY

Properties of fuels available in markets differ by country, region, season, and the like. In addition, the boiling points of the fuels at the same pressure also differ among the fuels available in the markets. Thus, the threshold of the fuel temperature as an execution condition of vapor lock prevention control as described above has to be set with an assumption that a fuel with the lowest boiling point is used. However, in practical use, a fuel with higher boiling point than the assumption may be used. Accordingly, when the fuel with the higher boiling point than the assumption is used, prevention processing is executed at unnecessarily higher frequencies. This may lead to an unnecessary increase of power consumption by a feed pump. As a result, this may further lead to unnecessary degradation of fuel economy of the internal combustion engine, which is caused by an increased power generation load.

The present disclosure provides a controller for an internal combustion engine and a control method therefor. The controller and the control method suppress shortage of injection pressure during injection of high-pressure fuel, which is caused by vapor lock of a high-pressure pump while suppressing degradation of fuel economy.

According to one aspect of the disclosure, a controller for an internal combustion engine is provided. The internal combustion engine includes: a feed pump configured to draw and discharge fuel from a fuel tank; a high-pressure pump configured to pressurize and discharge the fuel supplied from the feed pump; a high-pressure fuel pipe configured to store the fuel supplied from the high-pressure pump; a high-pressure fuel injection valve configured to inject the fuel stored in the high-pressure fuel pipe; and a fuel pressure sensor configured to detect fuel pressure in the high-pressure fuel pipe. The controller includes an electronic control unit. The electronic control unit is configured to execute: actuation control of the high-pressure pump so as to bring the fuel pressure in the high-pressure fuel pipe that is detected by the fuel pressure sensor to target fuel pressure; boost control for increasing pressure of the fuel that is supplied from the feed pump to the high-pressure pump; and the boost control when a state where the detected fuel pressure of the high-pressure fuel pipe is at most equal to first fuel pressure at least continues for a first specified time during the actuation control of the high-pressure pump. The first fuel pressure is specified pressure that is lower than the target fuel pressure.

In the controller for the internal combustion engine that is configured as described above, the fuel pressure in the high-pressure fuel pipe is controlled to be the target fuel pressure by the fuel pressure control section. Meanwhile, in the case where a fuel temperature in the high-pressure pump is raised and vapor lock occurs, a fuel supply from the high-pressure pump to the high-pressure fuel pipe stagnates. Accordingly, in the case where the vapor lock of the high-pressure pump occurs, the fuel pressure in the high-pressure fuel pipe falls below the target fuel pressure. Thus, when a state where the fuel pressure in the high-pressure fuel pipe is lower than the target fuel pressure at least continues for a certain time during actuation control of the high-pressure pump by the fuel pressure control section, the vapor lock of the high-pressure pump possibly occurs.

In regard to this point, the above controller for the internal combustion engine is provided with a boost control section that executes boost control for increasing pressure of the fuel supplied from the feed pump to the high-pressure pump when a state where the detection value of the fuel pressure is at most equal to a specified lowering determination fuel pressure that is lower than the target fuel pressure at least continues for a specified lowering determination time during the actuation control of the high-pressure pump by the fuel pressure control section. When the boost control is executed by such a boost control section, the pressure in the high-pressure pump is increased, and the boiling point of the fuel in the pump is raised. Thus, the vapor lock is eliminated. Therefore, shortage of injection pressure of the high-pressure fuel injection valves, which is caused by the vapor lock of the high-pressure pump, can be suppressed.

In such a controller for the internal combustion engine, such boost control is executed after the vapor lock of the high-pressure pump actually occurs. Accordingly, regardless of a property of the fuel in use, execution of the boost control at an unnecessarily early stage is prevented. Thus, according to the above controller for the internal combustion engine, the shortage of injection pressure during injection of the high-pressure fuel, which is caused by the vapor lock of the high-pressure pump, can efficiently be suppressed while degradation of fuel economy is suppressed.

According to the above structure, the first fuel pressure may be set as a value that is obtained by subtracting a determination value as a constant from the target fuel pressure. Noted that there is a case where the fuel pressure control section changes the target fuel pressure in accordance with an operational situation of the engine and variably controls the fuel pressure in the high-pressure fuel pipe. For example, the lowering determination fuel pressure is set as a value that is obtained by subtracting a lowering determination value as a constant from the target fuel pressure. In such a case, even in the case where the target fuel pressure is changed, occurrence of the vapor lock is detected when a state where the detection value of the fuel pressure is lowered by a certain amount from the target fuel pressure continues. Thus, also in the case where variable control of the fuel pressure is executed, the vapor lock of the high-pressure pump can further accurately be detected.

Meanwhile, in the case where the boost control as described above unnecessarily continues, degradation of fuel economy that is associated with an increase of a drive amount of the feed pump also unnecessarily continues for a long time. Thus, according to the above structure, the electronic control unit may be configured to terminate the boost control when an integrated value of a fuel injection amount of the high-pressure fuel injection valve after initiation of the boost control becomes at least equal to a specified value. On the other hand, in the case where the fuel pressure in the high-pressure fuel pipe is maintained to be constant, a fuel discharge amount by the high-pressure pump after elimination of the vapor lock substantially corresponds to an amount of fuel that is consumed from the high-pressure fuel pipe through the fuel injection by the high-pressure fuel injection valves. Accordingly, a degree of progress of cooling of the high-pressure pump can substantially be grasped from an integrated value of a fuel injection amount by the high-pressure fuel injection valves after initiation of the boost control. Thus, in the case where the boost control section in the above controller for the internal combustion engine terminates the boost control when the integrated value of the fuel injection amount by the high-pressure fuel injection valves after the initiation of the boost control becomes at least equal to a specified fuel temperature reduction determination value, the boost control can be terminated at appropriate timing at which the fuel temperature in the high-pressure pump is sufficiently reduced.

By the way, there is also a case where the detection value of the fuel pressure is lowered with respect to the target fuel pressure in the case where an malfunction other than the vapor lock of the high-pressure pump, such as fixation (sticking) of a movable section of the high-pressure pump, disconnection of an energization power line of the high-pressure pump, or an malfunction of the fuel pressure sensor (disconnection of a sensor signal line or the like), occurs to a fuel system of the internal combustion engine. In the case where the detection value of the fuel pressure is lowered with respect to the target fuel pressure due to any of those malfunctions, lowering of the detection value of the fuel pressure is not eliminated even when the boost control is executed. Accordingly, the boost control is unnecessarily executed. Thus, according to the above mentioned structure, the electronic control unit may be configured to terminate the boost control when a state where the detected fuel pressure of the high-pressure fuel pipe is at least equal to second fuel pressure at least continues for a second specified time after initiation of the boost control. The second fuel pressure may be specified fuel pressure that is lower than the target fuel pressure.

Meanwhile, even in the case where the vapor lock of the high-pressure pump is eliminated once by the above boost control, the fuel temperature in the high-pressure pump may further be raised and the vapor lock may occur again when the fuel injection by the high-pressure fuel injection valves is stopped. It is because the fuel inflow into and the fuel outflow from the high-pressure pump are not promoted. According to the above mentioned structure, the electronic control unit may be configured to initiate fuel injection by the high-pressure fuel injection valve after initiation of the boost control in a case where the fuel injection by the high-pressure fuel injection valve is stopped at a time when the boost control is initiated. In this way, the fuel inflow into and the fuel outflow from the high-pressure pump are promoted, and thus reoccurrence of the vapor lock can be suppressed.

By the way, in the case where the fuel injection by the high-pressure fuel injection valves is initiated by the above forced injection control section in a state where the vapor lock is not eliminated, the fuel is not supplied to the high-pressure fuel pipe until elimination of the vapor lock. Accordingly, in accordance with the above mentioned structure, the electronic control unit may be configured to initiate the fuel injection by the high-pressure fuel injection valve when a state where the detected fuel pressure of the high-pressure fuel pipe is at least equal to the target fuel pressure at least continues for a third specified time after the initiation of the boost control. In regard to this point, the forced injection control section in the above controller for the internal combustion engine initiates the fuel injection by the high-pressure fuel injection valves when a state where the detection value of the fuel pressure is at least equal to the target fuel pressure at least continues for a specified fuel pressure recovery determination time after the initiation of the boost control. In this way, the forced injection control is initiated after pressure-feeding of the fuel from the high-pressure pump to the high-pressure fuel pipe is resumed due to the elimination of the vapor lock and the lowered fuel pressure in the high-pressure fuel pipe is increased to become at least equal to the target fuel pressure. Therefore, shortage of the fuel injection pressure of the high-pressure fuel injection valves can be prevented.

In the internal combustion engine that includes, in addition to the high-pressure fuel injection valves as described above, low-pressure fuel injection valves that inject low-pressure fuel supplied from the feed pump without making the fuel flow through the high-pressure pump, the fuel injection valves for injecting can be switched in accordance with a situation. Meanwhile, during an idle operation in which sounds generated in the internal combustion engine are overall small, an actuation sound of the high-pressure pump is noticeable. Accordingly, there is a case where the fuel injection by the high-pressure fuel injection valves is stopped and the fuel is injected by the low-pressure fuel injection valves. When the forced injection control is terminated during the idle operation in such a case, the fuel injection by the high-pressure fuel injection valves is not resumed at least until termination of the idle operation. Accordingly, the vapor lock of the high-pressure pump may occur again. For this reason, the internal combustion engine may further include a low-pressure fuel injection valve that injects the fuel supplied from the feed pump without making the fuel flowing through the high-pressure pump. The electronic control unit may be configured to: stop the fuel injection by the high-pressure fuel injection valve and inject the fuel by the low-pressure fuel injection valve during an idle operation of the internal combustion engine; and continue the fuel injection by the high-pressure fuel injection valve until termination of the idle operation in a case where the fuel injection by the high-pressure fuel injection valve is initiated during the idle operation of the internal combustion engine.

According to another aspect of the disclosure, a control method for a fuel system is provided. The fuel system includes an internal combustion engine and an electronic control unit. The internal combustion engine includes: a feed pump configured to draw and discharge fuel from a fuel tank; a high-pressure pump configured to pressurize and discharge the fuel supplied from the feed pump; a high-pressure fuel pipe configured to store the fuel supplied from the high-pressure pump; a high-pressure fuel injection valve configured to inject the fuel stored in the high-pressure fuel pipe; and a fuel pressure sensor configured to detect fuel pressure in the high-pressure fuel pipe. The control method includes: executing actuation control of the high-pressure pump by the electronic control unit so as to bring the fuel pressure of the high-pressure fuel pipe detected by the fuel pressure sensor to target fuel pressure; executing boost control for increasing pressure of the fuel supplied from the feed pump to the high pressure pump by the electronic control unit; and executing the boost control by the electronic control unit when a state where the detected fuel pressure of the high-pressure fuel pipe is at most equal to first fuel pressure at least continues for a first specified time during the actuation control of the high-pressure pump. The first fuel pressure is specified pressure that is lower than the target fuel pressure.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
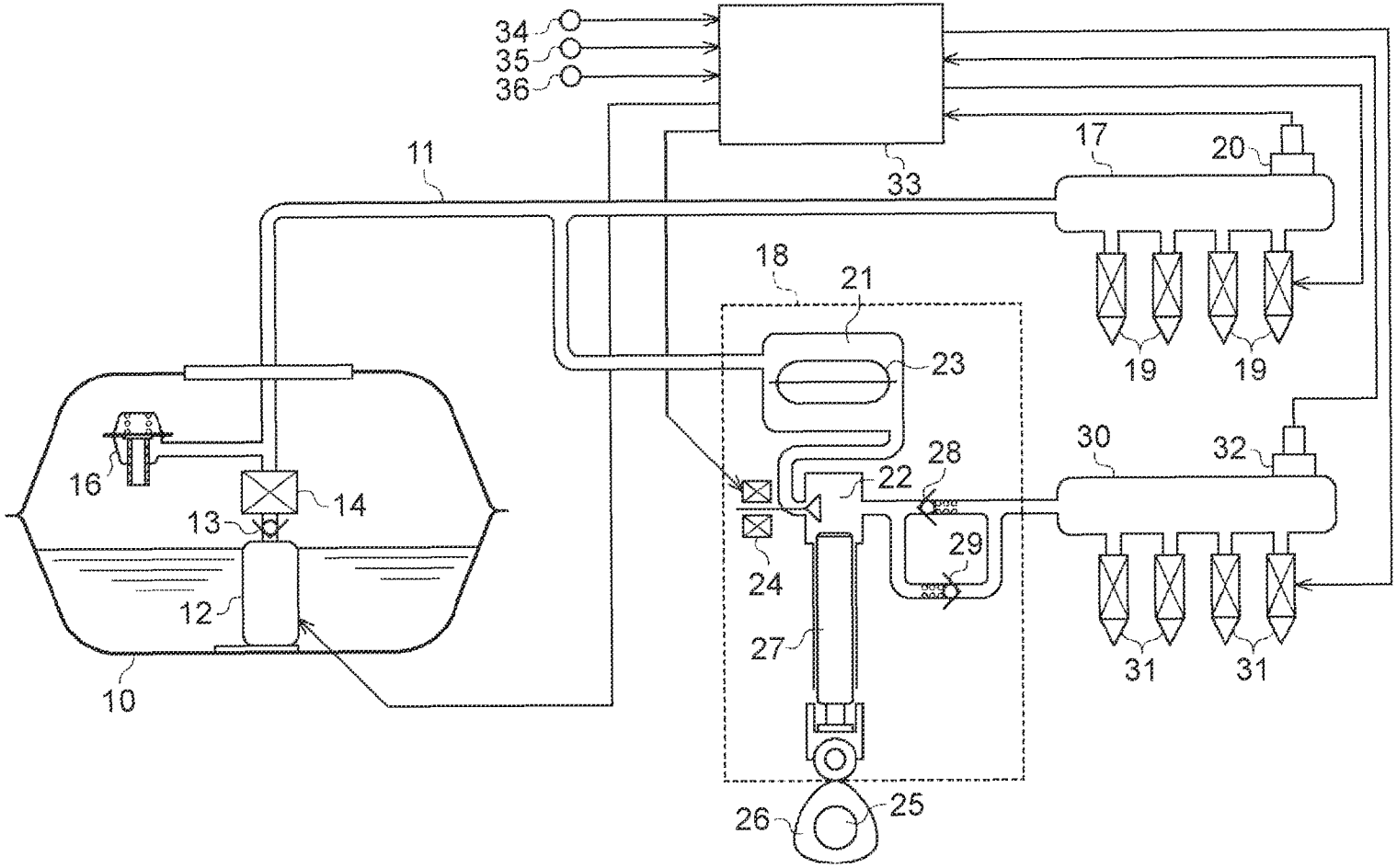
FIG. 1 is a view that schematically shows a configuration of a fuel system of an internal combustion engine, to which one embodiment of a controller for the internal combustion engine is applied.

A detailed description will hereinafter be made on an embodiment of a controller for an internal combustion engine with reference to FIG. 1 to FIG. 4. As shown in FIG. 1, a fuel system of the internal combustion engine, to which the controller of this embodiment is applied, includes a feed pump 12 that draws fuel from a fuel tank 10 and discharges the fuel to a low-pressure fuel passage 11. A first check valve 13 that prevents a reverse flow of the fuel is provided in a portion of the low-pressure fuel passage 11 that is connected to a fuel discharge opening of the feed pump 12. In addition, a filter 14 that filters the fuel is provided in a portion of the low-pressure fuel passage 11 that is on a downstream side of the first check valve 13.

Furthermore, a relief valve 16 is provided in the fuel tank 10. The relief valve 16 is opened when fuel pressure in the low-pressure fuel passage 11 exceeds specified relief pressure. The fuel in the low-pressure fuel passage 11 returns to the fuel tank 10 when the relief valve 16 is opened.

The low-pressure fuel passage 11 is divided into two passages on the outside of the fuel tank 10. One of the passages of the divided low-pressure fuel passage 11 is connected to a low-pressure fuel pipe 17, and the other of the passages is connected to a high-pressure pump 18. The low-pressure fuel pipe 17 is connected with low-pressure fuel injection valves 19 for port injection of cylinders that are respectively installed in intake ports of the cylinders of the internal combustion engine. In addition, a low-pressure side fuel pressure sensor 20 that detects fuel pressure in the low-pressure fuel pipe 17 is attached thereto.

Meanwhile, in the high-pressure pump 18 that is installed in a cam chamber of the internal combustion engine, two volume sections that are a fuel chamber 21 and a pressurization chamber 22 are provided. The low-pressure fuel passage 11 is connected to the fuel chamber 21. In addition, a pulsation damper 23 for damping fuel-pressure pulsation is installed in the fuel chamber 21. The high-pressure pump 18 further includes a plunger 27. The plunger 27 reciprocates in accordance with rotation of a cam 26 that is provided on a camshaft 25 of the internal combustion engine and changes a volume of the pressurization chamber 22 in accordance with the reciprocation.

The fuel chamber 21 and the pressurization chamber 22 are connected via a solenoid spill valve 24. The solenoid spill valve 24 is a valve of a normally open type that is closed in correspondence with energization. When the solenoid spill valve 24 is opened, the solenoid spill valve 24 communicates the fuel chamber 21 and the pressurization chamber 22. When the solenoid spill valve 24 is closed, the solenoid spill valve 24 shuts off communication between the fuel chamber 21 and the pressurization chamber 22.

Moreover, the pressurization chamber 22 is connected to a high-pressure fuel pipe 30 through two passages that respectively run through a second check valve 28 and a relief valve 29 that are provided in the high-pressure pump 18. The second check valve 28 is opened and permits discharge of the fuel from the pressurization chamber 22 to the high-pressure fuel pipe 30 when fuel pressure in the pressurization chamber 22 becomes higher than fuel pressure in the high-pressure fuel pipe 30 at least by specified discharge initiation pressure. The relief valve 29 is opened and permits relief of the fuel from the high-pressure fuel pipe 30 to the pressurization chamber 22 when the fuel pressure in the high-pressure fuel pipe 30 becomes higher than the fuel pressure in the pressurization chamber 22 at least by specified relief initiation pressure.

The high-pressure fuel pipe 30 is connected with high-pressure fuel injection valves 31 for in-cylinder injection of the cylinders that are respectively installed in the cylinders of the internal combustion engine. In addition, a high-pressure side fuel pressure sensor 32 that detects the fuel pressure in the high-pressure fuel pipe 30 is attached thereto.

The internal combustion engine with such a fuel system is controlled by an electronic control unit 33. The electronic control unit 33 includes: a central processing unit that executes various types of computation processing for engine control; a read only memory that stores a program and data for the control in advance; and a random access memory that temporarily stores computation results of the central processing unit, detection results of the sensors, and the like. In addition to detection signals of the low-pressure side fuel pressure sensor 20 and the high-pressure side fuel pressure sensor 32 that are described above, such an electronic control unit 33 receives detection signals of various sensors, such as a crank angle sensor 34, an airflow meter 35, and an accelerator pedal sensor 36. Noted that the crank angle sensor 34 detects a rotation phase of a crankshaft of the internal combustion engine and that the airflow meter 35 detects an intake air amount of the internal combustion engine. The accelerator pedal sensor 36 detects a depression amount of an accelerator pedal by a driver. The electronic control unit 33 executes actuation control of the feed pump 12 and the high-pressure pump 18 on the basis of the detection results of those sensors. The electronic control unit 33 also executes fuel injection control of the internal combustion engine through energization control of the low-pressure fuel injection valves 19 and the high-pressure fuel injection valves 31. Noted that the electronic control unit 33 computes and obtains an engine speed NE from the detection result of the crank angle sensor 34 and an engine load KL from the detection results of the airflow meter 35 and the accelerator pedal sensor 36.

The electronic control unit 33 controls actuation of the feed pump 12 so as to bring the fuel pressure in the low-pressure fuel pipe 17 (hereinafter described as low-pressure side fuel pressure Pf) to a set value of feed pressure. More specifically, on the basis of a deviation of the low-pressure side fuel pressure Pf that is detected by the low-pressure side fuel pressure sensor 20 from the set value of the feed pressure, the electronic control unit 33 adjusts a fuel discharge amount of the feed pump 12 in a manner to reduce the deviation. Here, the set value of the feed pressure is normally set to a specified low-pressure set value LO, and is set to a specified high-pressure set value HI that is higher than the low-pressure set value LO during boost control, which will be described below. Noted that each of the low-pressure set value LO and the high-pressure set value HI is set to be lower pressure than the relief pressure of the relief valve 16.

A pressurizing operation of the high-pressure pump 18 is performed as will be described below. Noted that, in the following description, movement of the plunger 27 in a direction to expand the volume of the pressurization chamber 22 during the reciprocation of the plunger 27 by the cam 26 will be described as descent of the plunger 27 and movement thereof in a direction to reduce the volume of the pressurization chamber 22 will be described as ascent of the plunger 27. When the plunger 27 descends in a state where the solenoid spill valve 24 is opened, the volume of the pressurization chamber 22 is expanded, and the fuel that has been delivered from the feed pump 12 to the fuel chamber 21 through the low-pressure fuel passage 11 is suctioned into the pressurization chamber 22 in correspondence with expansion of the volume. When the plunger 27 is shifted from descending to ascending, the volume of the pressurization chamber 22 is gradually reduced. If the solenoid spill valve 24 remains opened at this time, the fuel that has been suctioned in the pressurization chamber 22 is pushed back into the fuel chamber 21. In the case where the energization of the solenoid spill valve 24 is initiated and the solenoid spill valve 24 is closed during such ascent of the plunger 27, the pressurization chamber 22 is sealed, and the fuel pressure therein is increased in correspondence with the ascent of the plunger 27. Then, when the fuel pressure in the pressurization chamber 22 is increased to be higher than the fuel pressure in the high-pressure fuel pipe 30 at least by the discharge initiation pressure, the second check valve 28 is opened, and the fuel in the pressurization chamber 22 is discharged to the high-pressure fuel pipe 30. In such a high-pressure pump 18, a discharge amount of the pressurized fuel to the high-pressure fuel pipe 30 can be adjusted by changing energization initiation timing of the solenoid spill valve 24 in an ascending period of the plunger 27.

The electronic control unit 33 executes the actuation control of the high-pressure pump 18 through such control of the energization initiation timing of the solenoid spill valve 24. In addition, the electronic control unit 33 controls the actuation of the high-pressure pump 18 so as to bring the fuel pressure in the high-pressure fuel pipe 30 (hereinafter described as high-pressure side fuel pressure Pm) to target fuel pressure Pt that is set in accordance with an operational situation of the internal combustion engine. More specifically, in the actuation control of the high-pressure pump 18, the electronic control unit 33 first sets the target fuel pressure Pt on the basis of the engine load KL and the like. The target fuel pressure Pt is basically set to high pressure in an operational situation where a fuel injection amount Qd of the high-pressure fuel injection valves 31 is large, and is set to low pressure in an operational situation where the fuel injection amount Qd is small. Next, on the basis of a deviation of the high-pressure side fuel pressure Pm that is detected by the high-pressure side fuel pressure sensor 32 from the target fuel pressure Pt, the electronic control unit 33 adjusts the energization initiation timing of the solenoid spill valve 24 in the ascending period of the plunger 27. More specifically, when the high-pressure side fuel pressure Pm is higher than the target fuel pressure Pt, the energization initiation timing of the solenoid spill valve 24 in the ascending period of the plunger 27 is delayed so as to reduce the fuel discharge amount of the high-pressure pump 18 for each pressurizing operation. On the other hand, when the high-pressure side fuel pressure Pm is lower than the target fuel pressure Pt, the energization initiation timing of the solenoid spill valve 24 in the ascending period of the plunger 27 is hastened so as to increase the fuel discharge amount of the high-pressure pump 18 for each pressurizing operation. By adjusting the fuel discharge amount of the high-pressure pump 18, just as described, the electronic control unit 33 executes fuel pressure control for bringing the high-pressure side fuel pressure Pm to the target fuel pressure Pt.

Actuation sound is generated when the solenoid spill valve 24 of the high-pressure pump 18 is opened or closed. During an idle operation in which various sounds generated in the internal combustion engine are overall small, such actuation sound generated by opening or closing of the solenoid spill valve 24 is noticeable. Accordingly, such actuation sound possibly gives a sense of discomfort to the driver, and drivability is possibly degraded.

Meanwhile, when fuel injection by the high-pressure fuel injection valves 31 is stopped, the fuel in the high-pressure fuel pipe 30 is no longer consumed by the injection. Accordingly, the fuel in the high-pressure fuel pipe 30 is not reduced except for a slight amount of fuel leakage from the second check valve 28, the relief valve 29, and/or the high-pressure fuel injection valves 31. Thus, in the case where the high-pressure side fuel pressure Pm once reaches the target fuel pressure Pt, the high-pressure side fuel pressure Pm can thereafter be retained at the target fuel pressure Pt during stop of the fuel injection by the high-pressure fuel injection valves 31 even if the fuel is hardly supplied to the high-pressure fuel pipe 30. As a result, frequencies of the pressurizing operation of the high-pressure pump 18, in turn, frequencies of opening or closing of the solenoid spill valve 24 that is accompanied by generation of the actuation sound are reduced. For this reason, the electronic control unit 33 suppresses degradation of the drivability, which is caused by the actuation sound of the solenoid spill valve 24, by stopping the in-cylinder injection by the high-pressure fuel injection valves 31 and injecting the fuel through the port injection by the low-pressure fuel injection valves 19 during the idle operation of the internal combustion engine.

When the fuel injection by the high-pressure fuel injection valves 31 is stopped and the frequencies of the pressurizing operation of the high-pressure pump 18 are reduced by actuation sound suppression control as described above, fuel inflow into and fuel outflow from the pressurization chamber 22 hardly occur. Here, the high-pressure pump 18 is installed in the cam chamber that reaches a high temperature during the operation of the internal combustion engine. Thus, vapor is possibly produced in the pressurization chamber 22 when the inflow and outflow of the fuel do not occur.

In the case where a certain amount or more of the vapor exists in the pressurization chamber 22, even when the plunger 27 ascends in a state where the solenoid spill valve 24 is closed, the vapor is merely compressed, and liquid fuel is hardly pressurized. Accordingly, the high-pressure pump 18 is brought into a so-called vapor lock state, in which the pressurized fuel is not discharged even when the pressurizing operation of the high-pressure pump 18 is performed, and a fuel supply to the high-pressure fuel pipe 30 is disrupted.

Thus, the controller for the internal combustion engine of this embodiment handles such vapor lock of the high-pressure pump 18 through the boost control and forced injection control, which will be described below. Hereinafter, details of such control for elimination of such the vapor lock will be described.

Figure 2:
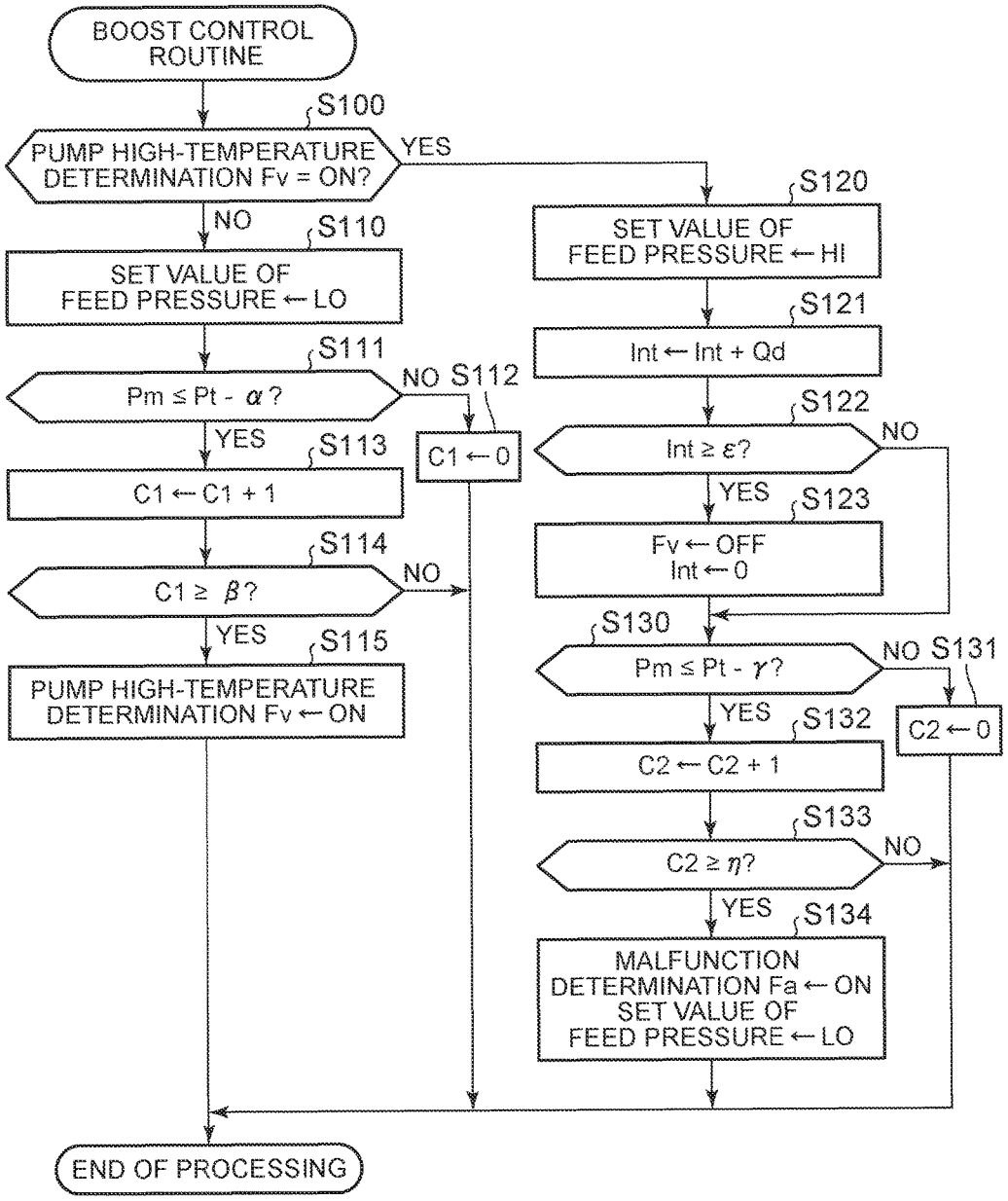
FIG. 2 is a flowchart of a boost control routine that is executed in the same embodiment.

FIG. 2 is a flowchart of a boost control routine. Processing of this routine is repeatedly executed by the electronic control unit 33 at specified control intervals during the operation of the internal combustion engine after completion of warming. Noted that, during the operation of the internal combustion engine after the completion of warming, during which the processing of this routine is executed, as described above, the actuation control of the high-pressure pump 18 is executed so as to bring a detection value of the high-pressure side fuel pressure Pm by the high-pressure side fuel pressure sensor 32 to the target fuel pressure Pt.

When the processing of this routine is initiated, it is first determined in step S100 whether a pump high-temperature determination Fv is "ON". The pump high-temperature determination Fv is a flag that is turned "ON" if it is determined that the vapor lock occurs in the high-pressure pump 18. Here, if the pump high-temperature determination Fv is "ON" (Yes), the processing proceeds to step S120. If "OFF" (NO), the processing proceeds to step S110.

If the pump high-temperature determination Fv is "OFF" and the processing proceeds to step S110, the set value of the feed pressure is set to the low-pressure set value LO in step S110. Then, through the processing in next step S111 to step S115, it is determined whether the vapor lock of the high-pressure pump 18 occurs.

In a determination of presence or absence of occurrence of the vapor lock, it is first determined in step S111 whether the detection value of the high-pressure side fuel pressure Pm by the high-pressure side fuel pressure sensor 32 is at most equal to specified lowering determination fuel pressure that is lower than the target fuel pressure Pt. The lowering determination fuel pressure is set as a value (=Pt−α) that is obtained by subtracting a lowering determination value α as a constant from the target fuel pressure Pt. The lowering determination fuel pressure is one example of the first fuel pressure. The lowering determination value α is one example of the determination value.

Here, if the detection value of the high-pressure side fuel pressure Pm exceeds the lowering determination fuel pressure (NO), a value of a lowering continuation time C1 is reset to "0" in step S112. Thereafter, the processing in this routine of this time is terminated. Noted that the lowering continuation time C1 is a counter that is used to measure a continuation time of a state where the detection value of the high-pressure side fuel pressure Pm is at most equal to the above specified fuel pressure. On the other hand, if the detection value of the high-pressure side fuel pressure Pm is at most equal to the lowering determination fuel pressure (S111: YES), "1" is added to the value of the lowering continuation time C1 in step S113, and it is determined in next step S114 whether the value of the lowering continuation time C1 is at least equal to a specified lowering determination time β. Here, if the value of the lowering continuation time C1 is smaller than the lowering determination time β (NO), the processing of this routine of this time is terminated as is. On the other hand, if the value of the lowering continuation time C1 is at least equal to the lowering determination time β (YES), the pump high-temperature determination Fv is turned "ON" in step S115. Thereafter, the processing of this routine of this time is terminated. That is, in this routine, it is determined that the vapor lock of the high-pressure pump 18 has occurred if a state where the detection value of the high-pressure side fuel pressure Pm by the high-pressure side fuel pressure sensor 32 is at most equal to the lowering determination fuel pressure that is lower than the target fuel pressure Pt at least continues for the specified lowering determination time β. This lowering determination time is one example of the first specified time.

Meanwhile, if the pump high-temperature determination Fv is "ON", that is, if it is determined that the vapor lock occurs in the high-pressure pump 18, the processing proceeds to step S120. Then, in step S120 onward, the boost control for increasing pressure of the fuel that is supplied from the feed pump 12 to the high-pressure pump 18 is executed.

In the boost control, first, in step S120, the set value of the feed pressure is set to the high-pressure set value HI. In this way, the actuation control of the feed pump 12 is executed so as to bring the low-pressure side fuel pressure Pf to the high-pressure set value HI, and the pressure of the fuel that is supplied from the feed pump 12 to the high-pressure pump 18 is increased.

Next, in step S121, the fuel injection amount Qd of the high-pressure fuel injection valves 31 is added to a value of an injection amount integrated value Int. The injection amount integrated value Int is a counter that indicates an integrated value of the fuel injection amount Qd of the high-pressure fuel injection valves 31 after initiation of the boost control, and the value is initialized to "0" at an engine start and upon termination of the boost control. In next step S122, it is determined whether the value of the injection amount integrated value Int is at least equal to a specified fuel temperature reduction determination value ε. The fuel temperature reduction determination value is one example of a specified value.

Here, if the value of the injection amount integrated value Int is smaller than the fuel temperature reduction determination value ε (S122: NO), the processing proceeds to step S130 as is. On the other hand, if the value of the injection amount integrated value Int is at least equal to the fuel temperature reduction determination value ε (YES), the pump high-temperature determination Fv is turned "OFF" and the value of the injection amount integrated value Int is initialized to "0" in next step S123. Thereafter, the processing proceeds to step S130. Noted that, in the case where the pump high-temperature determination Fv is turned "OFF", the processing proceeds to step S110 during next execution of the processing of this routine, and the set value of the feed pressure is set to the low-pressure set value LO in step S110. Accordingly, the boost control is terminated when the integrated value of the fuel injection amount Qd of the high-pressure fuel injection valves 31 (the injection amount integrated value Int) after initiation of the boost control becomes at least equal to the fuel temperature reduction determination value ε.

When the processing proceeds to step S130, it is determined in step S130 whether the detection value of the high-pressure side fuel pressure Pm is at most equal to specified non-recovery determination fuel pressure that is lower than the target fuel pressure Pt. The non-recovery determination fuel pressure is set as a value that is obtained by subtracting a non-recovery determination value γ as a constant from the target fuel pressure Pt. The non-recovery determination fuel pressure is one example of second fuel pressure. The non-recovery determination value γ is a determination value for determining whether the vapor lock of the high-pressure pump 18 is eliminated after the initiation of the boost control and the fuel pressure in the high-pressure fuel pipe 30 starts being increased. In this embodiment the same value as the above-described lowering determination value α is set for a value of the non-recovery determination value γ. That is, if the detection value of the high-pressure side fuel pressure Pm is at most equal to the non-recovery determination fuel pressure after the initiation of the boost control, the fuel pressure in the high-pressure fuel pipe 30 still remains in a lowered state.

Here, if the detection value of the high-pressure side fuel pressure Pm exceeds the non-recovery determination fuel pressure (NO), a value of a non-recovery continuation time C2 is reset to "0" in step S131. Thereafter, the processing of this routine of this time is terminated. Noted that the non-recovery continuation time C2 is a counter that is used to measure a continuation time of a state where the detection value of the high-pressure side fuel pressure Pm is at most equal to the non-recovery determination fuel pressure after the initiation of the boost control. On the other hand, if the detection value of the high-pressure side fuel pressure Pm is at most equal to the non-recovery determination fuel pressure (S130: YES), "1" is added to the value of the non-recovery continuation time C2 in step S132, and it is determined in next step S133 whether the value of the non-recovery continuation time C2 is at least equal to a specified non-recovery determination time η. Here, if the value of the non-recovery continuation time C2 is smaller than the non-recovery determination time η (NO), the processing of this routine of this time is terminated as is. The non-recovery determination time is one example of a second specified time.

On the other hand, if the value of the non-recovery continuation time C2 is at least equal to the non-recovery determination time η (YES), an malfunction determination Fa is set "ON" and the set value of the feed pressure is set to the low-pressure set value LO in step S134. Thereafter, the processing of this routine of this time is terminated. That is, at this time, the set value of the feed pressure that is set to the high-pressure set value HI in step S120 is set again to the low-pressure set value LO. Accordingly, the boost control is not executed.

Noted that the malfunction determination Fa is a flag that is set "ON" when it is determined that an malfunction that causes lowering of the fuel pressure in the high-pressure fuel pipe 30 and that is other than the vapor lock of the high-pressure pump 18 occurs to the fuel system of the internal combustion engine. By the way, such an malfunction includes fixation (sticking) of a movable section of the high-pressure pump 18, disconnection of an energization power line of the high-pressure pump 18, malfunction of the high-pressure side fuel pressure sensor 32 (disconnection of a sensor signal line and the like), and the like. Noted that, when the malfunction determination Fa is set "ON", an indicator for notifying occurrence of the malfunction is lit, and engine control for limp form that enables a retreat travel is executed instead of the normal engine control.

Figure 3:
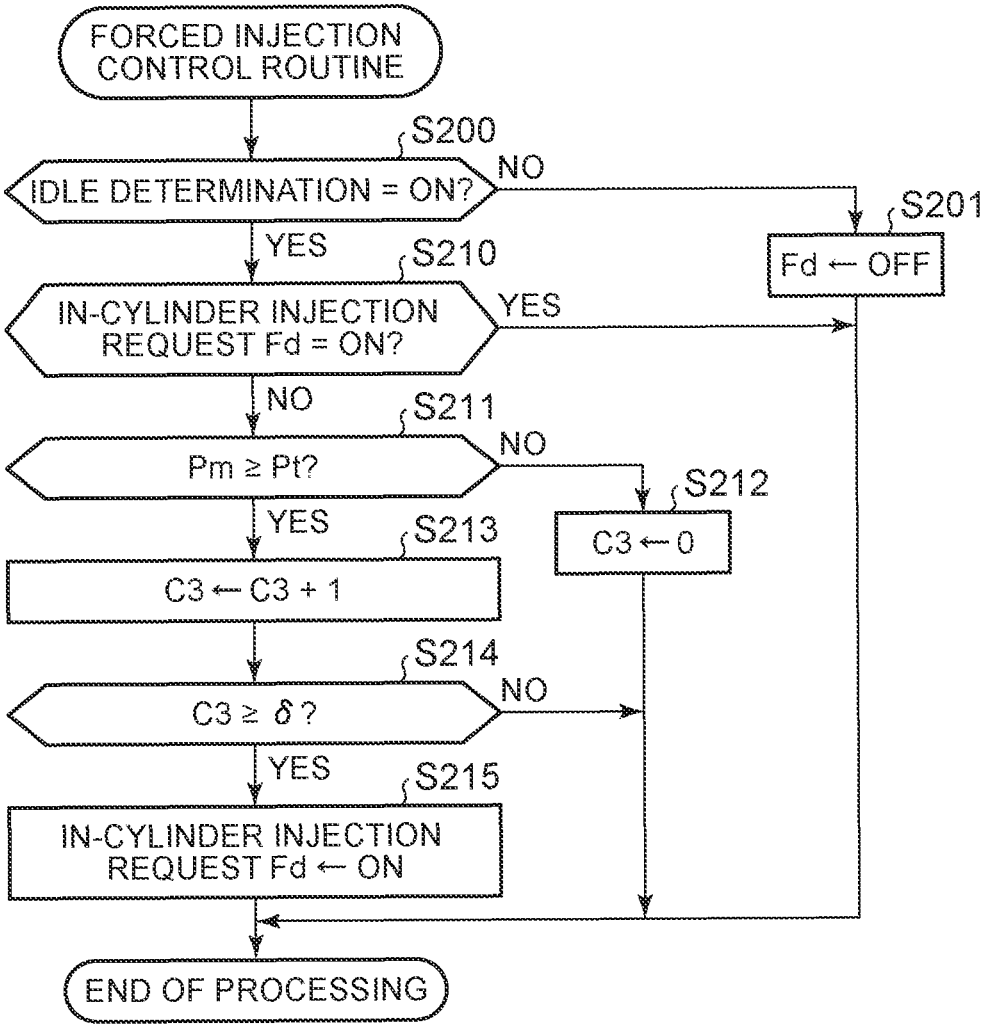
FIG. 3 is a flowchart of a forced injection control routine that is executed in the same embodiment.

FIG. 3 shows a flowchart of a forced injection control routine. Similar to the boost control routine, processing of this routine is also repeatedly executed by the electronic control unit 33 at specified control intervals during the operation of the internal combustion engine after the completion of warming.

When the processing of this routine is initiated, it is first determined in step S200 whether an idle determination is set (ON). The idle determination is a flag that is set "ON" when the idle operation of the internal combustion engine is performed. Noted that, during initiation of the idle operation of the internal combustion engine, the in-cylinder injection by the high-pressure fuel injection valves 31 is stopped, and the fuel is injected through the port injection by the low-pressure fuel injection valves 19 in the above-described actuation sound suppression control.

Here, if the idle determination is "ON" (YES), the processing proceeds to step S210. On the other hand, if the idle determination is "OFF" (NO), an in-cylinder injection request Fd is set "OFF" in step S201. Thereafter, the processing of this routine of this time is terminated. Noted that the in-cylinder injection request Fd is a flag that is set "ON" when forced execution of the fuel injection by the high-pressure fuel injection valves 31 is requested. An injection ratio of the in-cylinder injection/the port injection is set such that the injection ratio of the in-cylinder injection is forcibly set to "100%" at a time when this in-cylinder injection request Fd is "ON".

If the idle determination is "ON" and the processing proceeds to step S210, it is determined in step S210 whether the in-cylinder injection request Fd is "ON". Here, if the in-cylinder injection request Fd is "ON" (YES), the processing of this routine of this time is terminated as is. If the in-cylinder injection request Fd is "OFF" (NO), the processing proceeds to step S211.

If the in-cylinder injection request Fd is "OFF" and the processing proceeds to step S211, in the processing in step S211 onward, a determination is made to decide timing at which the in-cylinder injection request Fd is set "ON", that is, timing at which the forced injection control for forcibly executing the fuel injection by the high-pressure fuel injection valves 31 is initiated. This determination is made on the basis of the continuation time of a state where the detection value of the high-pressure side fuel pressure Pm is at least equal to the target fuel pressure Pt after the initiation of the boost control. In addition, this continuation time is measured by using a counter that is a fuel pressure recovery continuation time C3.

In the determination, it is first determined in step S211 whether the detection value of the high-pressure side fuel pressure Pm by the high-pressure side fuel pressure sensor 32 is at least equal to the target fuel pressure Pt. Here, if the detection value of the high-pressure side fuel pressure Pm is lower than the target fuel pressure Pt (NO), a value of the fuel pressure recovery continuation time C3 is reset to "0" in step S212. Thereafter, the processing of this routine of this time is terminated. On the other hand, if the detection value of the high-pressure side fuel pressure Pm is at least equal to the target fuel pressure Pt (S211: YES), "1" is added to the value of the fuel pressure recovery continuation time C3 in step S213, and it is then determined in step S214 whether the value of the fuel pressure recovery continuation time C3 is at least equal to a specified fuel pressure recovery determination time δ. Here, if the value of the fuel pressure recovery continuation time C3 is smaller than the fuel pressure recovery determination time δ (NO), the processing of this routine of this time is terminated as is. On the other hand, if the value of the fuel pressure recovery continuation time C3 is at least equal to the fuel pressure recovery determination time δ (YES), the in-cylinder injection request Fd is set "ON" in step S215. Thereafter, the processing of this routine of this time is terminated. That is, in this routine, the forced injection control is initiated when a state where the detection value of the high-pressure side fuel pressure Pm by the high-pressure side fuel pressure sensor 32 is at least equal to the target fuel pressure Pt at least continues for the specified fuel pressure recovery determination time δ after the initiation of the boost control. Noted that the in-cylinder injection request Fd is operated from "ON" to "OFF" if the idle determination is set "OFF" (S200: NO) and the processing in step S201 is executed. Accordingly, in the case where the in-cylinder injection request Fd is set "ON" during the idle operation, the fuel injection by the high-pressure fuel injection valves 31 continues until termination of the idle operation. The fuel pressure recovery determination time is one example of a third specified time.

Next, a description will be made on an action of the controller for the internal combustion engine of this embodiment that is realized by the boost control and the forced injection control that have been described so far.

Figure 4:
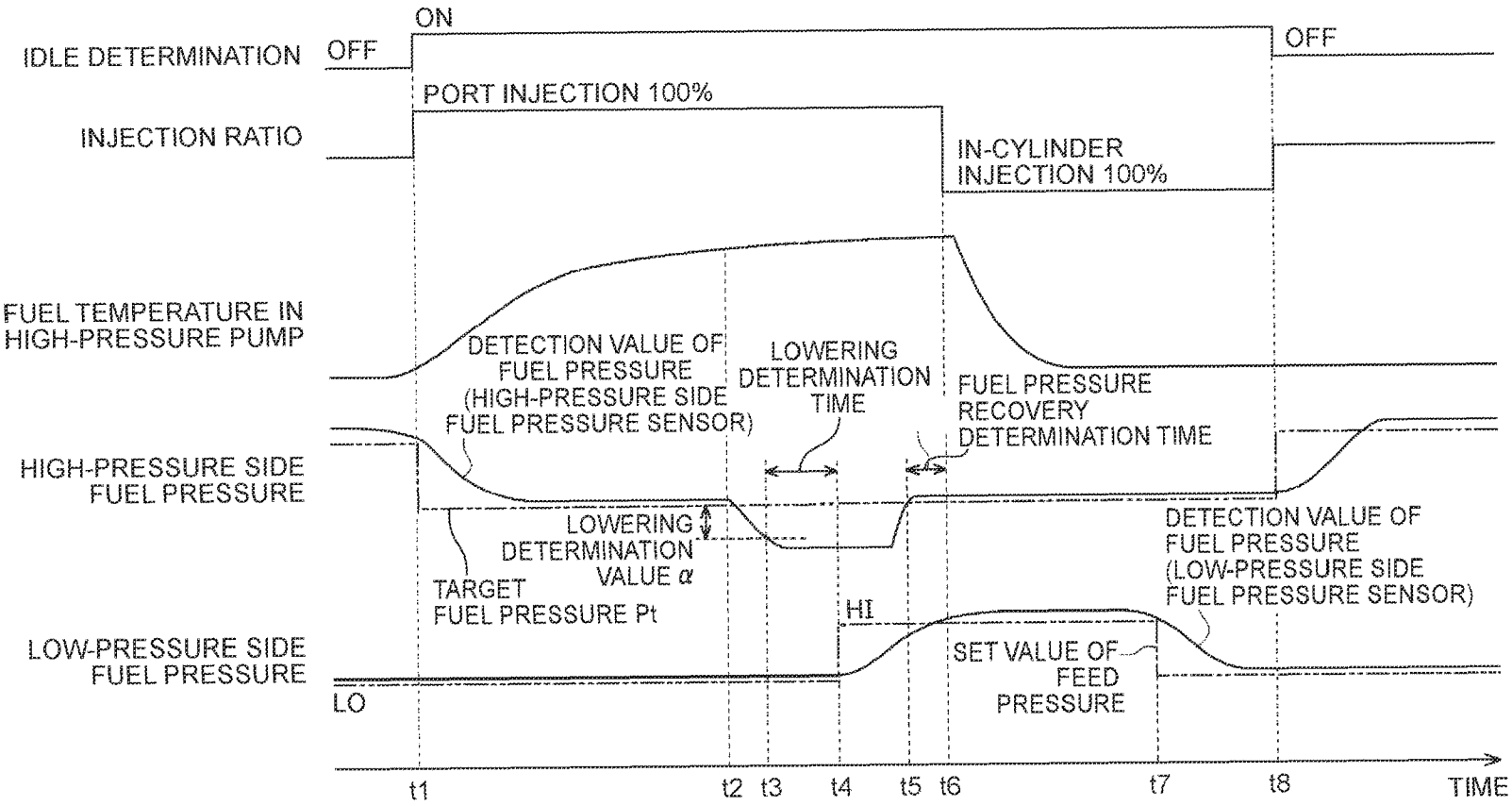
FIG. 4 is a time chart that shows one example of each of boost control and forced injection control in the same embodiment.

FIG. 4 shows one example of a control aspect during the occurrence of the vapor lock. In the example of the drawing, the idle determination is set "ON" at time t1, and the idle operation of the internal combustion engine is initiated. Once the idle operation is initiated, the injection ratio of the port injection is set to "100%" by the actuation sound suppression control, and the fuel injection by the high-pressure fuel injection valves 31 is stopped. In addition, at this time, the target fuel pressure Pt is set to the lower pressure. As a result, a state where the high-pressure side fuel pressure Pm by the high-pressure side fuel pressure sensor 32 is higher than the target fuel pressure Pt is generated, and the high-pressure pump 18 stops the pressurizing operation. Noted that, although the fuel in the high-pressure fuel pipe 30 is not consumed by the injection at this time, a slight amount of the fuel is leaked from the high-pressure fuel pipe 30 to the high-pressure pump 18 side via the second check valve 28 and the relief valve 29, and thus the high-pressure side fuel pressure Pm is gradually lowered. Even after the high-pressure side fuel pressure Pm is lowered to the target fuel pressure Pt, the high-pressure pump 18 occasionally discharges a small amount of the fuel so as to compensate for a leaked amount of the fuel. Accordingly, in the high-pressure pump 18 after the initiation of the idle operation, the fuel inflow into and the fuel outflow from the pressurization chamber 22 hardly occur, and a fuel temperature in the pressurization chamber 22 is gradually raised by ambient heat. Then, at time t2 in the same drawing, the fuel temperature in the pressurization chamber 22 is raised until the fuel is vaporized, and the vapor lock of the high-pressure pump 18 occurs.

In the case where the vapor lock of the high-pressure pump 18 occurs and the fuel is leaked from the high-pressure fuel pipe 30, the leaked amount of the fuel is not supplied thereto. Thus, the fuel pressure in the high-pressure fuel pipe 30 (the high-pressure side fuel pressure Pm) is gradually lowered from the target fuel pressure Pt. Then, at time t3, the high-pressure side fuel pressure Pm is lowered until a lowered amount thereof with respect to the target fuel pressure Pt becomes at least equal to the lowering determination value α, that is, the high-pressure side fuel pressure Pm is lowered to become at most equal to the lowering determination fuel pressure that is set as a value obtained by subtracting the lowering determination value α from the target fuel pressure Pt. Thereafter, when this state continues until time t4 at which a time required for counting up of the lowering continuation time C1 for the lowering determination time β elapses, it is determined that the vapor lock occurs in the high-pressure pump 18. Then, the boost control is initiated, and the actuation control of the feed pump 12 is executed so as to increase the low-pressure side fuel pressure Pf to the high-pressure set value HI.

When the low-pressure side fuel pressure Pf is increased, the fuel pressure in the pressurization chamber 22 of the high-pressure pump 18 is also increased, and the boiling point of the fuel in the pressurization chamber 22 is raised. Accordingly, the vapor lock of the high-pressure pump 18 is eliminated. Once the vapor lock is eliminated, the high-pressure pump 18 starts discharging the fuel again. Thus, the high-pressure side fuel pressure Pm is increased until reaching the target fuel pressure Pt.

It can be determined that the vapor lock is eliminated if a state where the high-pressure side fuel pressure Pm is at least equal to the target fuel pressure Pt continues for a certain duration of a period. In this embodiment, the high-pressure side fuel pressure Pm becomes at least equal to the target fuel pressure Pt at time t5. Thereafter, when this state continues until time t6 at which a time required for counting up of the fuel pressure recovery continuation time C3 for the fuel pressure recovery determination time δ elapses, the forced injection control is initiated. That is, the fuel injection by the high-pressure fuel injection valves 31 is forcibly initiated during the idle operation in which the fuel injection by the high-pressure fuel injection valves 31 is originally stopped.

When such forced injection control is initiated, the injection ratio of the in-cylinder injection is set to "100%", and the fuel is injected through the in-cylinder injection by the high-pressure fuel injection valves 31. When the in-cylinder injection by the high-pressure fuel injection valves 31 is initiated, just as described, the high-pressure pump 18 performs the pressurizing operation to compensate the high-pressure fuel pipe 30 for the amount of the fuel that is consumed by the injection in order to maintain the high-pressure side fuel pressure Pm at the target fuel pressure Pt. Then, the high-pressure pump 18 is cooled by the fuel that flows through the pressurization chamber 22 in the pressurizing operation.

Noted that an amount of the fuel that flows through the pressurization chamber 22 of the high-pressure pump 18 and is delivered to the high-pressure fuel pipe 30 after the initiation of the boost control substantially corresponds to the amount of the fuel that is injected by the high-pressure fuel injection valves 31 after the initiation of the boost control. Accordingly, cooling of the high-pressure pump 18 progresses in correspondence with an increase in an integrated value of the fuel injection amount by the high-pressure fuel injection valves 31 (the injection amount integrated value Int) after the initiation of the boost control. Thus, when the injection amount integrated value Int reaches a certain value, it can be determined that the high-pressure pump 18 is sufficiently cooled. In this embodiment, when the injection amount integrated value Int reaches the fuel temperature reduction determination value ε at time t7, the pump high-temperature determination Fv is set "OFF", and the boost control is terminated. That is, the actuation control of the feed pump 12 is executed to return the low-pressure side fuel pressure Pf that has been increased to the high-pressure set value HI to the low-pressure set value LO.

Noted that, because the vapor lock has already occurred once at this time, it is considered that the high-pressure pump 18 is in a situation where the fuel temperature of which is easily increased. Accordingly, in the case where all of the control is resumed to the normal control during the idle operation at this time point, that is, in the case where the forced injection control is terminated and the fuel is injected through the port injection, the fuel inflow into and the fuel outflow from the pressurization chamber 22 are stopped again. Thus, the vapor lock possibly occurs again. In regard to this point, in this embodiment, the injection ratio of the in-cylinder injection remains "100%" and the fuel injection by the high-pressure fuel injection valves 31 continues even after the termination of the boost control. Thus, the fuel inflow into and the fuel outflow from the pressurization chamber 22 continue, and the fuel temperature in the pressurization chamber 22 can be suppressed from being increased again.

The forced injection control continues until time t8 at which the idle operation is terminated and the idle determination is set "OFF". After the termination of the idle operation, the fuel at a ratio of the in-cylinder injection/the port injection that corresponds to the operational situation of the internal combustion engine is injected.

Noted that the vapor lock of the high-pressure pump 18 occurs while the fuel injection by the high-pressure fuel injection valves 31 is stopped during the idle operation. Meanwhile, in the case where a generation amount of vapor in the high-pressure pump 18 is small, it may take a long time until the high-pressure side fuel pressure Pm is lowered. In such a case, the boost control may be initiated after the termination of the idle operation. As a result, the fuel injection by the high-pressure fuel injection valves 31 may be resumed before the vapor lock of the high-pressure pump 18 is eliminated by the boost control.

In the high-pressure fuel pipe 30 at this time, an amount of the fuel that is supplied through the fuel injection by the high-pressure fuel injection valves 31 is consumed in a state where a supply of the fuel from the high-pressure pump 18 is disrupted. Thus, the fuel pressure therein (the high-pressure side fuel pressure Pm) is lowered after the fuel injection by the high-pressure fuel injection valves 31 is resumed. However, the generation amount of the vapor is small at this time. Thus, when the boost control is initiated, the vapor lock of the high-pressure pump 18 is promptly eliminated. For this reason, lowering of the fuel pressure in the high-pressure fuel pipe 30 at this time is merely temporal, and an influence thereof on the operation of the internal combustion engine remains relatively small.

By the way, there is a case where the high-pressure side fuel pressure Pm in the high-pressure fuel pipe 30 is lowered by a cause other than the vapor lock of the high-pressure pump 18. For example, the malfunction of the fuel system of the internal combustion engine, such as fixation (sticking) of the movable section of the high-pressure pump 18, disconnection of the energization power line of the high-pressure pump 18, and the malfunction of the high-pressure side fuel pressure sensor 32 (the disconnection of the sensor signal line and the like), which have been described above, can be such a cause.

During occurrence of any of these malfunctions, lowering of the fuel pressure in the high-pressure fuel pipe 30 is not eliminated even when the boost control is executed. Thus, the normal termination condition (S122: YES) may not be established, and the boost control may unnecessarily be continued. In regard to this point, in this embodiment, the boost control is terminated in the case where the state where the detection value of the high-pressure side fuel pressure Pm is at most equal to the non-recovery determination fuel pressure (=Pt−γ) that is lower than the target fuel pressure Pt at least continues for the specified non-recovery determination time η after the initiation of the boost control. Accordingly, the boost control, which occurs in the case where the fuel pressure in the high-pressure fuel pipe 30 is lowered by the cause other than the vapor lock of the high-pressure pump 18, unnecessarily continues only for the non-recovery determination time η. Furthermore, in this case, it is determined that the malfunction other than the vapor lock of the high-pressure pump 18 occurs to the fuel system of the internal combustion engine, and a measure against the malfunction is taken.

Noted that, in the embodiment as described above, the electronic control unit 33 is configured to correspond to the "fuel pressure control section", the "boost control section", the "forced injection control section", and the "injection switching section". In addition, of two fuel pressure sensors that are the low-pressure side fuel pressure sensor 20 and the high-pressure side fuel pressure sensor 32, the high-pressure side fuel pressure sensor 32 corresponds to the "fuel pressure sensor for detecting fuel pressure in a high-pressure fuel pipe". Furthermore, the detection value of the high-pressure side fuel pressure Pm by the high-pressure side fuel pressure sensor 32 corresponds to the "detection value of the fuel pressure by the fuel pressure sensor".

According to the controller for the internal combustion engine of this embodiment that has been described so far, the following effects can be realized. In this embodiment, the electronic control unit 33 executes the fuel pressure control, in which the actuation control of the high-pressure pump 18 is executed, so as to bring the detection value of the high-pressure side fuel pressure Pm by the high-pressure side fuel pressure sensor 32 to the target fuel pressure Pt. Then, the electronic control unit 33 executes the boost control to increase the pressure of the fuel that is supplied from the feed pump 12 to the high-pressure pump 18 (the low-pressure side fuel pressure Pf) in the case where the state where the detection value of the high-pressure side fuel pressure Pm is at most equal to the specified lowering determination fuel pressure (=Pt−α) that is lower than the target fuel pressure Pt at least continues for the specified lowering determination time during the fuel pressure control. Accordingly, when the vapor lock of the high-pressure pump 18 occurs, it is possible to increase the fuel pressure in the pressurization chamber 22 of the high-pressure pump 18, raise the boiling point of the fuel in the pressurization chamber 22, and return the generated vapor to the liquid fuel, that is, eliminate the vapor lock. In addition, the boost control is executed when the occurrence of the vapor lock is actually confirmed. Thus, regardless of a property of the fuel in use, it is possible to prevent the execution of the boost control at an unnecessarily early stage. Therefore, shortage of injection pressure during injection of the high-pressure fuel, which is caused by the vapor lock of the high-pressure pump 18, can efficiently be suppressed while degradation of fuel economy is suppressed.

During the boost control, a high-output operation of the feed pump 12 is performed. Thus, when the boost control is executed at high frequencies, durability of components, such as a brush, may be degraded. In regard to this point, in this embodiment, because the execution of the boost control in an originally unnecessary situation can be suppressed, degradation of the durability of the components of the feed pump 12 can be suppressed.

Even in the case where the vapor lock of the high-pressure pump 18 is eliminated once by the boost control, the fuel inflow into and the fuel outflow from the pressurization chamber 22 of the high-pressure pump 18 do not occur when the stop of the fuel injection by the high-pressure fuel injection valves 31 continues. Accordingly, the vapor lock may occur again in a state where the fuel temperature in the high-pressure pump 18 is further increased and the fuel pressure in the pressurization chamber 22 is increased by the boost control. In regard to this point, in this embodiment, the electronic control unit 33 executes the forced injection control, in which the fuel is forcibly injected by the high-pressure fuel injection valves 31, after the initiation of the boost control. Thus, the fuel inflow into and the fuel outflow from the pressurization chamber 22 of the high-pressure pump 18 are promoted. Therefore, reoccurrence of the vapor lock can be suppressed.

In this embodiment, the electronic control unit 33 initiates the forced injection control in the case where the state where the detection value of the high-pressure side fuel pressure Pm by the high-pressure side fuel pressure sensor 32 is at least equal to the target fuel pressure Pt at least continues for the specified fuel pressure recovery determination time after the initiation of the boost control. Thus, it is possible to prevent initiation of the forced injection control in a state where the vapor lock is not eliminated and thus to prevent the shortage of the injection pressure of the high-pressure fuel injection valves 31.

In this embodiment, the electronic control unit 33 terminates the boost control in the case where the integrated value of the fuel injection amount Qd of the high-pressure fuel injection valves 31 (the injection amount integrated value Int) after the initiation of the forced injection control becomes at least equal to the specified fuel temperature reduction determination value s. Thus, the boost control can be terminated at a time point when the high-pressure pump 18 is appropriately cooled. Therefore, it is possible to suppress degradation of the fuel economy, which is caused by unnecessary continuation of the boost control.

In this embodiment, because the forced injection control continues until the idle operation is terminated. Thus, the reoccurrence of the vapor lock can be suppressed. The boost control is terminated in the case where the state where the detection value of the high-pressure side fuel pressure Pm is at most equal to the specified non-recovery determination fuel pressure (=Pt−γ) that is lower than the target fuel pressure Pt at least continues for the specified non-recovery determination time η after the initiation of the boost control. Thus, the boost control, which occurs in the case where the fuel pressure in the high-pressure fuel pipe 30 is lowered by the cause other than the vapor lock of the high-pressure pump 18, unnecessarily continues only for the non-recovery determination time η. In addition, the vapor lock of the high-pressure pump 18 and the malfunction of the fuel system by the cause other than the vapor lock can be distinguished from each other. Thus, an appropriate measure can be taken against each event.

Noted that the above embodiment can be changed and implemented as follows. In the above embodiment, the value of the non-recovery determination value γ is the same value as the lowering determination value cc. However, those may be different values. Noted that, in the case where the value of the non-recovery determination value γ is only used to determine whether to cancel lowering of the fuel pressure by the boost control, the value of the non-recovery determination value γ is desirably set to the same value to or a slightly smaller value than the lowering determination value α. On the other hand, in the case where it is desired to determine the presence or the absence of such an malfunction that a degree of lowering of the fuel pressure of the high-pressure fuel pipe 30 is gradually increased or the like, the value of the non-recovery determination value γ may desirably be set to a larger value than the lowering determination value α.

In the above embodiment, the lowering determination fuel pressure that is used to determine the presence or absence of the occurrence of the vapor lock is set as the value that is obtained by subtracting the lowering determination value α as a constant from the target fuel pressure Pt. That is, the lowering determination fuel pressure is variably set in accordance with a change of the target fuel pressure Pt. The lowering determination fuel pressure may be set as a fixed value in the case where variable control of the high-pressure side fuel pressure Pm is not executed and the target fuel pressure Pt is a fixed value or in the case where the variable control is executed but the target fuel pressure Pt is constant during execution of the boost control routine. Furthermore, in the case where the variable control of the high-pressure side fuel pressure Pm is executed, the lowering determination fuel pressure may be set to lower pressure than a lower limit value within a control range of the high-pressure side fuel pressure Pm as a constant. In such a case, when the fuel system functions normally, a state where the high-pressure side fuel pressure Pm falls below the lower limit value within the control range thereof does not continue. Thus, lowering of the high-pressure side fuel pressure Pm by the vapor lock can be detected.

Similar to the lowering determination fuel pressure, the non-recovery determination fuel pressure may also be set as a fixed value in the case where the variable control of the high-pressure side fuel pressure Pm is not executed and the target fuel pressure Pt is the fixed value or in the case where the variable control is executed but the target fuel pressure Pt is constant during the execution of the boost control routine. Furthermore, in the case where the variable control of the high-pressure side fuel pressure Pm is executed, the non-recovery determination fuel pressure may be set to the lower pressure than the lower limit value within the control range of the high-pressure side fuel pressure Pm as the constant.

In the above embodiment, in the boost control routine, in the processing of step S134 that is executed in the case where the state where the detection value of the high-pressure side fuel pressure Pm is at most equal to the specified non-recovery determination fuel pressure that is lower than the target fuel pressure Pt at least continues for the specified non-recovery determination time η after the initiation of the boost control, the boost control is terminated, and it is determined that the malfunction other than the vapor lock of the high-pressure pump 18 occurs to the fuel system of the internal combustion engine (S134). Such a determination of the malfunction may be made in different processing, and the boost control may only be terminated in the processing of step S134 of the boost control routine.

In the case where the occurrence of the malfunction other than the vapor lock of the high-pressure pump 18 to the fuel system of the internal combustion engine is determined in the different processing, step S130 to step S133 of the boost control routine may be omitted, and the boost control may be terminated in accordance with the malfunction determination in the processing. In addition, when it can be considered that there is no cause other than the vapor lock of the high-pressure pump 18 as the cause of lowering the fuel pressure in the high-pressure fuel pipe 30, step S130 to step S133 of the boost control routine may simply be omitted.

In the above embodiment, the forced injection control continues until the idle operation is terminated. However, the forced injection control may be terminated at another timing. For example, it can be considered to terminate the forced injection control at the same time as the boost control or to determine an execution time of the forced injection control in advance and terminate the forced injection control at a time point when the execution time elapses from initiation of the control.

In the above embodiment, the boost control is terminated when the integrated value of the fuel injection amount Qd of the high-pressure fuel injection valves 31 after the initiation of the boost control becomes at least equal to the specified fuel temperature reduction determination value E. However, the boost control may be terminated at another timing. For example, in the case where correlation between the intake air amount and the fuel injection amount Qd is high, an integrated value of the intake air amount after the initiation of the forced injection control is used instead of the injection amount integrated value Int. In such a case, a similar effect can be realized. In addition, it can also be considered to decide an execution time of the boost control in advance and terminate the boost control at a time point when the execution time elapses from initiation of the control.

In the above embodiment, the forced injection control is initiated in the case where the state where the detection value of the high-pressure side fuel pressure Pm by the high-pressure side fuel pressure sensor 32 is at least equal to the target fuel pressure Pt at least continues for the specified fuel pressure recovery determination time after the initiation of the boost control. Initiation timing of such forced injection control may be set to another timing. For example, a time from the initiation of the boost control to the initiation of the forced injection control may be decided in advance. Then, the forced injection control may be initiated at a time point when the time elapses from the initiation of the boost control. Alternatively, the forced injection control may be initiated at the same time as the initiation of the boost control. Noted that, even in the case where the forced injection control is initiated in a state where the vapor lock of the high-pressure pump 18 is not eliminated, the shortage of the injection pressure does not occur when the vapor lock is promptly eliminated thereafter.

In the above embodiment, the injection ratio of the in-cylinder injection during the forced injection control is set to "100%". However, even in the case where not all of the fuel is injected through the in-cylinder injection, the fuel inflow into and the fuel outflow from the pressurization chamber 22 are promoted as long as the in-cylinder injection is performed. Thus, the reoccurrence of the vapor lock can be suppressed.

In the above embodiment, the forced injection control is executed after the initiation of the boost control. However, the forced injection control may not be executed when the vapor lock that has occurred only needs to be eliminated.

Next, technical ideas that can be grasped from the above embodiment and a modified example thereof and effects of those will be described below. A controller for an internal combustion engine is applied to an internal combustion engine including: a feed pump that draws and discharges fuel from a fuel tank; a high-pressure pump that pressurizes and discharges the fuel supplied from the feed pump; a high-pressure fuel pipe that stores the fuel supplied from the high-pressure pump; high-pressure fuel injection valves that inject the fuel stored in the high-pressure fuel pipe, and the controller for the internal combustion engine is characterized by including: a boost control section that executes boost control for increasing pressure of the fuel supplied from the feed pump to the high-pressure pump in the case where a specified condition, which is used to determine that vapor lock of the high-pressure pump occurs or that a state where the vapor lock is likely to occur is generated, is established; and a forced injection control section that initiates fuel injection by the high-pressure fuel injection valves after the initiation of the boost control in the case where the fuel injection by the high-pressure fuel injection valves is stopped at a time when the boost control is initiated.

In the above configuration, in the case where the vapor lock of the high-pressure pump occurs, or in the case where the state where the vapor lock is likely to occur is generated, the boost control for increasing the pressure of the fuel that is supplied from the feed pump to the high-pressure pump is executed. When the boost control is executed, the pressure in the high-pressure pump is increased, and the boiling point of the fuel in the pump is raised. Accordingly, the vapor lock is eliminated. However, even in the case where the vapor lock of the high-pressure pump is eliminated once by such boost control, a fuel temperature in the high-pressure pump may further be increased and the vapor lock may occur again when a stop of the fuel injection by the high-pressure fuel injection valves continues. It is because fuel inflow into and fuel outflow from the high-pressure pump do not occur. In regard to this point, in the above controller for the internal combustion engine, in the case where the fuel injection by the high-pressure fuel injection valves is stopped at the time when the boost control is initiated, the fuel injection by the high-pressure fuel injection valves is initiated after the initiation of the boost control so as to prevent stagnation of the fuel in the high-pressure pump. Thus, reoccurrence of the vapor lock can be prevented.

In the internal combustion engine according to the above aspect, a fuel pressure sensor that detects fuel pressure in the high-pressure fuel pipe is provided, said controller of the above mentioned internal combustion engine includes a fuel pressure control section that executes actuation control of the high-pressure pump so as to bring a detection value of the fuel pressure by the fuel pressure sensor to target fuel pressure, and the forced injection control section initiates fuel injection by the high-pressure fuel injection valves when a state where the detection value of the fuel pressure is at least equal to the target fuel pressure at least continues for a specified fuel pressure recovery determination time after the initiation of the boost control.

In the case where the fuel injection by the high-pressure fuel injection valves is initiated in a state where the vapor lock is not eliminated, the fuel is not supplied to the high-pressure fuel pipe until elimination of the vapor lock. Accordingly, the fuel pressure in the high-pressure fuel pipe may be lowered in correspondence with fuel consumption by injection, and fuel injection pressure of the high-pressure fuel injection valves may become insufficient. In regard to this point, in the above controller for the internal combustion engine, the fuel injection by the high-pressure fuel injection valves is initiated when the state where the detection value of the fuel pressure is at least equal to the target fuel pressure at least continues for the specified fuel pressure recovery determination time after the initiation of the boost control and the vapor lock is eliminated certainly. Therefore, shortage of the fuel injection pressure of the high-pressure fuel injection valves can be prevented.

In the internal combustion engine according to the above aspect, the boost control section terminates the boost control when a state where the detection value of the fuel pressure is at most equal to specified non-recovery determination fuel pressure that is lower than the target fuel pressure at least continues for a specified non-recovery determination time after the initiation of the boost control.

There is also a case where the detection value of the fuel pressure is lowered with respect to the target fuel pressure in the case where an malfunction other than the vapor lock of the high-pressure pump, such as fixation (sticking) of a movable section of the high-pressure pump, disconnection of an energization power line of the high-pressure pump, or an malfunction of the fuel pressure sensor (disconnection of a sensor signal line or the like), occurs to a fuel system of the internal combustion engine. In the case where the detection value of the fuel pressure is lowered with respect to the target fuel pressure due to any of those malfunctions, lowering of the detection value of the fuel pressure is not eliminated and a state where the detection value of the fuel pressure falls below the target fuel pressure continues even with execution of the boost control. Accordingly, when the state where the detection value of the fuel pressure is at most equal to the specified non-recovery determination fuel pressure that is lower than the target fuel pressure at least continues for the specified non-recovery determination time after the initiation of the boost control, the boost control is terminated. In this way, unnecessary continuation of the boost control can be suppressed.

In the internal combustion engine according to the above aspect, the boost control section terminates the boost control in the case where an integrated value of a fuel injection amount by the high-pressure fuel injection valves after the initiation of the boost control becomes at least equal to a specified fuel temperature reduction determination value.

In the case where the boost control continues unnecessarily, degradation of fuel economy that is associated with an increase of a drive amount of the feed pump also unnecessarily continues for a long time. In regard to this point, in the above controller for the internal combustion engine, the boost control can be terminated at appropriate timing at which the integrated value of the fuel injection amount by the high-pressure fuel injection valves after the initiation of the boost control becomes at least equal to the specified fuel temperature reduction determination value and at which the fuel temperature in the high-pressure pump is sufficiently reduced.

In the internal combustion engine according to the above aspect, the internal combustion engine includes a low-pressure fuel injection valves that inject the fuel supplied from the feed pump without making the fuel flow through the high-pressure pump, said controller of the above mentioned internal combustion engine includes an injection switching section that stops the fuel injection by the high-pressure fuel injection valves during an idle operation of the internal combustion engine and that injects the fuel by the low-pressure fuel injection valves, and the forced injection control section continues the fuel injection by the high-pressure fuel injection valves until termination of the idle operation in the case where the fuel injection by the high-pressure fuel injection valves is initiated during the idle operation of the internal combustion engine.

A situation where the fuel temperature in the high-pressure pump is likely to be raised is caused by occurrence of the vapor lock. Meanwhile, in the above controller for the internal combustion engine, the fuel injection by the high-pressure fuel injection valves is stopped and the fuel is injected by the low-pressure fuel injection valves during the idle operation. Accordingly, in the case where the fuel injection by the high-pressure fuel injection valves is initiated during the idle operation and the fuel injection is terminated while the idle operation continues, the vapor lock may occur again. In regard to this point, in the above controller for the internal combustion engine, such fuel injection by the high-pressure fuel injection valves continues until the termination of the idle operation. Thus, the reoccurrence of the vapor lock can be suppressed.

The invention claimed is:

1. A controller for an internal combustion engine including a feed pump configured to draw and discharge fuel from a fuel tank, a high-pressure pump configured to pressurize and discharge the fuel supplied from the feed pump, a high-pressure fuel pipe configured to store the fuel supplied from the high-pressure pump, a high-pressure fuel injection valve configured to inject the fuel stored in the high-pressure fuel pipe, a low-pressure fuel injection valve configured to inject the fuel supplied from the feed pump without making the fuel flow through the high-pressure pump, and a fuel pressure sensor configured to detect fuel pressure in the high-pressure fuel pipe, the controller comprising:

an electronic control unit configured to execute actuation control of the high-pressure pump so as to bring the fuel pressure in the high-pressure fuel pipe that is detected by the fuel pressure sensor to target fuel pressure, the electronic control unit being configured to execute boost control for increasing pressure of the fuel that is supplied from the feed pump to the high-pressure pump, the electronic control unit being configured to execute the boost control when a state where the detected fuel pressure of the high-pressure fuel pipe is at most equal to a first fuel pressure at least continues for a first specified time during the actuation control of the high-pressure pump, and the first fuel pressure being a specified pressure that is lower than the target fuel pressure, and the electronic control unit being configured to initiate fuel injection by the high-pressure fuel injection valve and reduce a fuel injection amount of the low-pressure fuel injection valve after initiation of the boost control in a case where the fuel injection by the high-pressure fuel injection valve is stopped and the fuel is injected by the low-pressure fuel injection valve at a time when the boost control is initiated.

2. The controller according to claim 1, wherein the first fuel pressure is a value that is obtained by subtracting a determination value as a constant from the target fuel pressure.

3. The controller according to claim 1, wherein the electronic control unit is configured to terminate the boost control when an integrated value of a fuel injection amount of the high-pressure fuel injection valve after initiation of the boost control becomes at least equal to a specified value.

4. The controller according to claim 1, wherein the electronic control unit is configured to terminate the boost control when a state where the detected fuel pressure of the high-pressure fuel pipe is at least equal to a second fuel pressure at least continues for a second specified time after initiation of the boost control, and the second fuel pressure is a specified fuel pressure that is lower than the target fuel pressure.

5. The controller according to claim 1, wherein the electronic control unit is configured to initiate the fuel injection by the high-pressure fuel injection valve when a state where the detected fuel pressure of the high-pressure fuel pipe is at least equal to the target fuel pressure at least continues for a third specified time after the initiation of the boost control.

6. The controller according to claim 1, wherein the electronic control unit is configured to stop the fuel injection by the high-pressure fuel injection valve and inject the fuel by the low-pressure fuel injection valve during an idle operation of the internal combustion engine, and the electronic control unit is configured to continue the fuel injection by the high-pressure fuel injection valve until termination of the idle operation in a case where the fuel injection by the high-pressure fuel injection valve is initiated during the idle operation of the internal combustion engine.

7. The controller according to claim 4, wherein the second fuel pressure is a specified fuel pressure that is lower than the target fuel pressure, the second fuel pressure is different than the first fuel pressure.

8. The controller according to claim 1, wherein the electronic control unit is configured to initiate fuel injection by the high-pressure fuel injection valve and stop the fuel injection by the low-pressure fuel injection valve after initiation of the boost control in a case where the fuel injection by the high-pressure fuel injection valve is stopped and the fuel is injected by the low-pressure fuel injection valve at a time when the boost control is initiated.

9. A control method for a fuel system, the fuel system including an internal combustion engine and an electronic control unit, the internal combustion engine including:

a feed pump configured to draw and discharge fuel from a fuel tank, a high-pressure pump configured to pressurize and discharge the fuel supplied from the feed pump, a high-pressure fuel pipe configured to store the fuel supplied from the high-pressure pump, a high-pressure fuel injection valve configured to inject the fuel stored in the high-pressure fuel pipe, a low-pressure fuel injection valve configured to inject the fuel supplied from the feed pump without making the fuel flow through the high-pressure pump, and a fuel pressure sensor configured to detect fuel pressure in the high-pressure fuel pipe, the control method comprising:

executing actuation control of the high-pressure pump by the electronic control unit so as to bring the fuel pressure of the high-pressure fuel pipe detected by the fuel pressure sensor to target fuel pressure;

executing boost control for increasing pressure of the fuel supplied from the feed pump to the high pressure pump by the electronic control unit;

executing the boost control by the electronic control unit when a state where the detected fuel pressure of the high-pressure fuel pipe is at most equal to a first fuel pressure at least continues for a first specified time during the actuation control of the high-pressure pump, the first fuel pressure being a specified pressure that is lower than the target fuel pressure; and initiating fuel injection by the high-pressure fuel injection valve and reducing a fuel injection amount of the low-pressure fuel injection valve after initiation of the boost control in a case where the fuel injection by the high-pressure fuel injection valve is stopped and the fuel is injected by the low-pressure fuel injection valve at a time when the boost control is initiated by the electronic control unit.

10. The control method of claim 9, wherein the electronic control unit is configured to initiate fuel injection by the high-pressure fuel injection valve and stop fuel injection by the low-pressure fuel injection valve after initiation of the boost control in a case where the fuel injection by the high-pressure fuel injection valve is stopped and the fuel is injected by the low-pressure fuel injection valve at the time when the boost control is initiated by the electronic control unit.

* * * * *